US006176572B1

(12) United States Patent
Kato et al.

(10) Patent No.: US 6,176,572 B1
(45) **Date of Patent: *Jan. 23, 2001**

(54) INK JET RECORDER

(75) Inventors: Hitoshi Kato, Itami; Takeshi Yamashita, Kawanishi; Tomoko Yamamoto, Takarazuka, all of (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/874,918

(22) Filed: Jun. 13, 1997

(30) Foreign Application Priority Data

Jun. 13, 1996 (JP) ..... 8-175898
Jan. 10, 1997 (JP) ..... 9-002484

(51) Int. Cl.[7] ..... B41J 2/175
(52) U.S. Cl. ..... 347/87
(58) Field of Search ..... 347/85, 86, 87, 347/92, 93

(56) References Cited

U.S. PATENT DOCUMENTS 4,675,693 * 6/1987 Yano et al. ..... 347/20
4,931,811 6/1990 Cowger et al. ..... 347/87
5,509,140 * 4/1996 Koitabashi et al. ..... 347/86
5,604,523 2/1997 Tsukuda et al. ..... 347/86
5,790,158 * 8/1998 Shinada et al. ..... 347/86

FOREIGN PATENT DOCUMENTS 8-132633 * 5/1996 (JP) .

* cited by examiner

*Primary Examiner*—N. Le
*Assistant Examiner*—Michael Nghiem
(74) *Attorney, Agent, or Firm*—Sidley & Austin

(57) ABSTRACT

An ink jet recorder according to the present invention comprises an ink cartridge having an ink supply port for supplying ink to a recording head and an ink holding member composed of a porous member for holding the ink, the ink holding member being so provided inside the ink cartridge as to cover the ink supply port, and a recording head communicating with the ink supply port of the ink cartridge and having a plurality of nozzle holes provided therein, wherein the following conditions are satisfied, letting S0 ($mm^2$) be the cross-sectional area of an opening in the ink supply port, S1 ($mm^2$) be the total sum of the cross-sectional areas of openings in the plurality of nozzle holes, and S2 ($mm^2$) be the average of the cross-sectional areas of holes in the ink holding member:

$$(1/S2)\times(1/35)>S0\geqq S1\times 5$$

14 Claims, 8 Drawing Sheets

INK JET RECORDER

BACKGROUND OF THE INVENTION

1. Field of the Invention

The present invention relates generally to an ink jet recorder for supplying ink to a recording head from an ink supply port provided in an ink cartridge and for discharging the ink from a nozzle hole provided in the recording head to record characters and the like on paper, and more particularly, to an ink jet recorder in which a sufficient amount of ink can be supplied to a recording head from an ink cartridge, and the ink in the ink cartridge hardly leaks.

2. Description of the Related Art

A conventional ink jet recorder has been so generally constructed that an ink holding member 11 composed of a porous member for holding ink 1 is contained inside an ink cartridge 10, an ink supply port 12 for supplying the ink 1 to a recording head 20 and a vent hole 13 for introducing air into the ink cartridge 10 are provided in the ink cartridge 10. The ink supply port 12 in the ink cartridge 10 and the recording head 20 communicate with each other by connecting means 30, as shown in FIG. 1.

The ink 1 held in the ink holding member 11 provided inside the ink cartridge 10 is supplied to the recording head 20 through the ink supply port 12. The ink 1 is discharged from a plurality of nozzle holes 21 provided in the recording head 20 to record characters and the like on paper. Air is introduced into the ink cartridge 10 through the vent hole 13, to keep pressure inside the ink cartridge 10 constant.

In such an ink jet recorder, in cases such as a case where the ink 1 is supplied to the recording head 20 from the ink cartridge 10 at high speed, the ink 1 cannot be sufficiently supplied to the recording head 20, resulting in insufficient printing, for example.

In the prior art, in order to sufficiently supply the ink 1 from the ink cartridge 10 to the recording head 20 as described above, therefore, it has been examined that the ink supply port 12 communicating with the recording head 20 is made large, to supply a large amount of ink 1 to the recording head 20 through the ink supply port 12. When the ink supply port 12 is thus made large, however, leakage of the ink 1 from the ink cartridge 10 is increased.

SUMMARY OF THE INVENTION

The present invention has been made in order to solve the above-mentioned problems in an ink jet recorder for supplying ink to a recording head from an ink supply port provided in an ink cartridge and for discharging ink from a nozzle hole provided in the recording head to record characters and the like on paper.

An object of the present invention is to make it possible to make stable recording by stably supplying a sufficient amount of ink to a recording head in cases such as a case where the ink is supplied to the recording head from an ink supply port provided in an ink cartridge at high speed as described above.

Another object of the present invention is to prevent, even in a case where a sufficient amount of ink is stably supplied to a recording head from an ink supply port provided in an ink cartridge, the ink in the ink cartridge from leaking from the ink supply port.

In order to attain the above-mentioned objects, an ink jet recorder according to the present invention comprises an ink cartridge having an ink supply port for supplying ink to a recording head and an ink holding member composed of a porous member for holding the ink, the ink holding member being so arranged inside the ink cartridge as to cover the ink supply port, and a recording head communicating with the ink supply port of the ink cartridge, the recording head having a plurality of nozzle holes, wherein the following conditions are satisfied, where S0 ($mm^2$) is the cross-sectional area of an opening in the ink supply port, S1 ($mm^2$) is the total sum of the cross-sectional areas of openings for the plurality of nozzle holes, and S2 ($mm^2$) is the average of the cross-sectional areas of holes in the ink holding member:

$$(1/S2)\times(1/35)>S0\geqq S1\times 5$$

In the ink jet recorder, when the relationship between the sum S1 ($mm^2$) of the cross-sectional areas of the openings in all the nozzle holes in the recording head and the cross-sectional area S0 ($mm^2$) of the opening in the ink supply port in the ink cartridge satisfies $S0\geqq S1\times 5$, a sufficient amount of ink can be stably supplied to the recording head through the ink supply port, so that the ink can be stably discharged from each of the nozzle holes in the recording head.

Furthermore, when the relationship between the cross-sectional area S0 ($mm^2$) of the opening in the ink supply port and the average S2 ($mm^2$) of the cross-sectional areas of the holes in the ink holding member provided in the ink cartridge satisfies $(1/S2)\times(1/35)>S0$, the ink is sufficiently held in the ink holding member. Even when the ink supply port is made large, the ink in the ink cartridge is prevented from leaking.

As in the ink jet recorder according to the present invention, when the sum S1 ($mm^2$) of the cross-sectional areas of the openings in all the nozzle holes in the recording head, the cross-sectional area S0 ($mm^2$) of the opening in the ink supply port in the ink cartridge, and the average S2 ($mm^2$) of the cross-sectional areas of the holes in the ink holding member composed of the porous member for holding the ink contained in the ink cartridge are so set as to satisfy the foregoing conditions, a sufficient amount of ink is stably supplied to the recording head from the ink cartridge, whereby the recording head is prevented from being clogged with air bubbles upon inflow of the air bubbles into the recording head. Therefore, the ink is stably discharged through each of the nozzle holes in the recording head, so that stable recording can be made, and the ink in the ink cartridge is inhibited from leaking.

An ink cartridge according to the present invention has an ink supply port having a plurality of openings provided therein for supplying ink exterior to the ink cartridge. The sum of the cross-sectional areas of the openings is not less than 0.25 $mm^2$.

When a plurality of openings for supplying the ink to the exterior are provided as in the ink cartridge according to the present invention, the area of each of the openings is decreased, and the ink is inhibited from leaking by capillary action in the opening. Further, the sum of the cross-sectional areas of the openings is not less than 0.25 $mm^2$. Even when a large amount of ink is consumed as in a case where printing is continuously done, therefore, the ink is stably supplied to the recording head through each of the openings in the ink supply port, whereby stable recording can be made.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Embodiments of an ink jet recorder according to the present invention will be specifically described on the basis of accompanying drawings, and it will be made clear by giving comparative examples that even in a case where ink is supplied to a recording head at high speed, the ink is stably supplied to the recording head, and the ink in an ink cartridge is inhibited from leaking.

(Embodiment 1)

Figure 1:
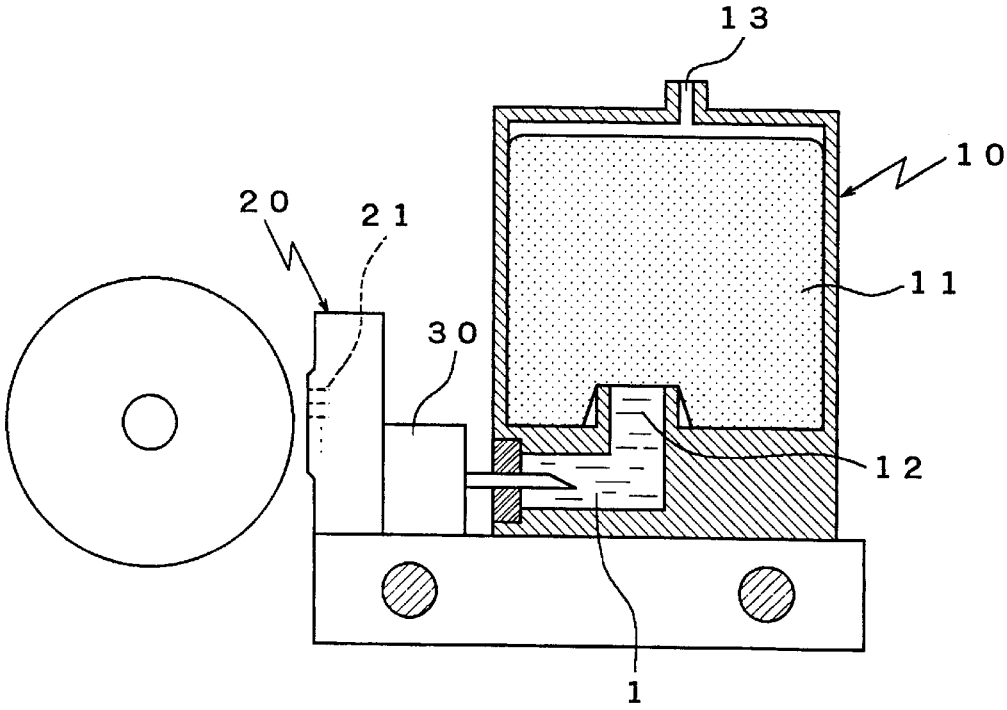
Fig1 prior art
FIG. 1 is a partially sectional view of a conventional ink jet recorder.
Figure 2:
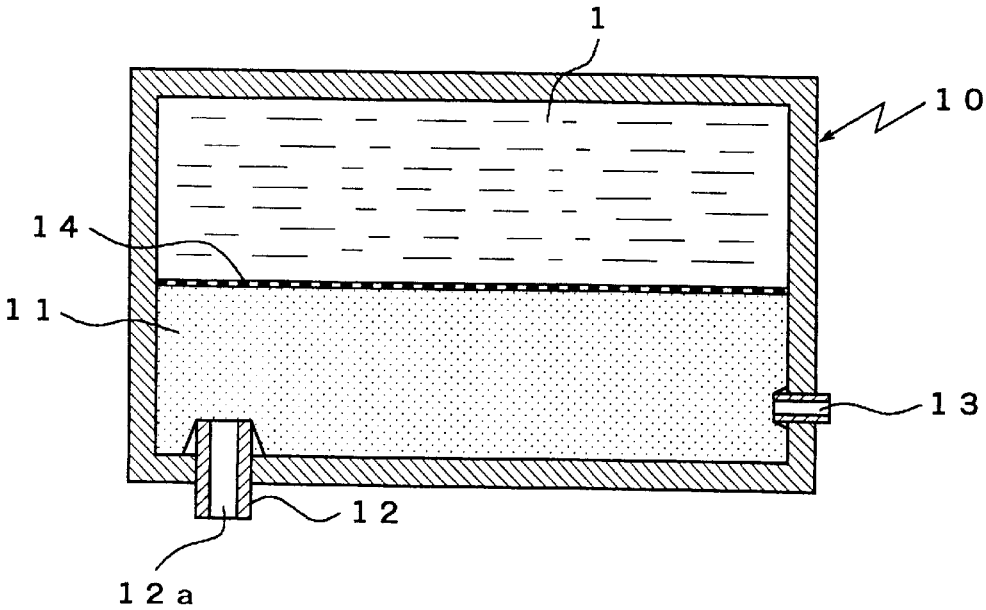
FIG. 2 is a cross-sectional view of an ink cartridge in general accordance with embodiments 1 through 6 of the present invention and also comparative examples 1 through 6.

In the present embodiment, an ink cartridge 10 in the shape of a box having a height of 20 mm, a depth of 20 mm and a width of 35 mm and is formed using translucent ABS resin. An ink supply port 12 having an opening 12*a*, the diameter of which is 1 mm, is provided in a bottom surface of the ink cartridge 10, and a vent hole 13 for introducing air into the ink cartridge 10 is provided in a lower part of a side surface, which is spaced apart from the ink supply port 12, of the ink cartridge 10, as shown in FIG. 2.

Furthermore, a partition plate 14 having a plurality of holes is provided in the ink cartridge 10 in such a manner as to separate the ink cartridge 10 into upper and lower parts, so that the volume of a containing section on the side of the lower part is 30%. An ink holding member 11 is contained in the containing section on the side of the lower part.

In the present embodiment, examples of the ink holding member 11 is composed of a polyurethane sponge having a specific gravity of 0.052 g/cc and average hole diameter of 0.25 mm. Moreover, the holding member 11 has a volume which is 1.95 times the volume of the containing section on the side of the lower part. The ink holding member 11 is contained in a compressed state in the containing section on the side of the lower part. When the ink holding member 11 is thus contained, the average diameter of the holes in the ink holding member 11 is approximately 0.20 mm.

The ink 1 is water-based ink having a viscosity of 2 cP and having surface tension of 30 dyn/cm. The ink 1 is contained in the ink containing section on the side of the upper part in the ink cartridge 10, and the ink holding member 11 is impregnated with the ink 1.

Figure 3:
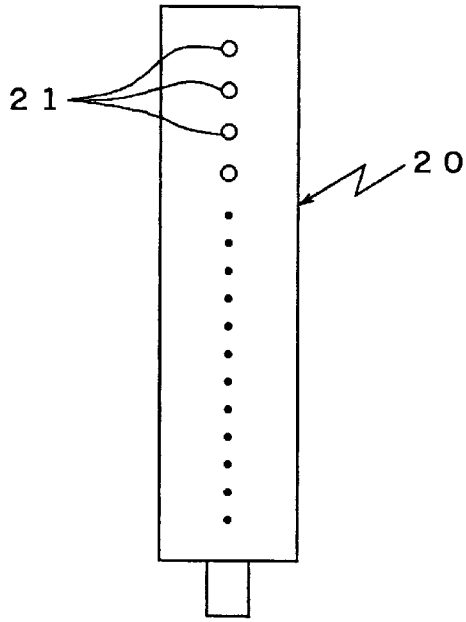
FIG. 3 is a front view of a recording head used in the ink jet recorders in the embodiments and the comparative examples of the present invention.

In the present embodiment, a recording head 20 having 75 nozzle holes 21, where the nozzle diameter of each nozzle hole 21 is 50 $\mu$m, as shown in FIG. 3. The recording head 20 is caused to communicate with the ink supply port 12 in the ink cartridge 10.

(Embodiment 2)

The present embodiment is the same as the above-mentioned embodiment 1 except that in the ink cartridge 10 of embodiment 2, the diameter of the opening 12*a* in the ink supply port 12 is 0.9 mm. Another example of a recording head 20 has 50 nozzle holes 21, where the nozzle diameter of each nozzle hole 21 is 50 $\mu$m.

(Embodiment 3)

The present embodiment is the same as the above-mentioned embodiment 1 except that in the ink cartridge 10 of embodiment 3, the diameter of the opening 12*a* in the ink supply port 12 is 0.6 mm. For this embodiment, the ink holding member 11 is one composed of a polyurethane sponge having a specific gravity of 0.052 g/cc and an average hole diameter of 0.3 mm. The volume of the ink holding member is the same as the volume of the containing section on the side of the lower part in the ink cartridge 10, the ink holding member 11 being contained in the containing section on the side of the lower part. The average diameter of the holes in the ink holding member 11 thus contained in the containing section is approximately 0.3 mm. Another example of a recording head 20 for this embodiment has 30 nozzle holes 21, where the nozzle diameter of each nozzle hole 21 is 30 $\mu$m.

(Embodiment 4)

The present embodiment is the same as the above-mentioned embodiment 1 except that in the ink cartridge 10 of embodiment 4, the diameter of the opening 12*a* in the ink supply port 12 is 0.3 mm. For this embodiment, the ink holding member 11 is composed of a polyurethane sponge having a specific gravity of 0.045 g/cc and an average hole diameter of 0.45 mm. For this embodiment, the volume of the ink holding member 11 is the same as the volume of the containing section on the side of the lower part in the ink cartridge 10, the ink holding member 11 being contained in the containing section on the side of the lower part. The average diameter of the holes in the ink holding member 11 thus contained in the containing section is approximately 0.45 mm, is approximately 0.45 mm. Another example of a recording head 20 has 20 nozzle holes 21, where the nozzle diameter of each nozzle hole 21 is 20 $\mu$m.

(Embodiment 5)

The present embodiment is the same as the above-mentioned embodiment 1 except that in the ink cartridge 10 of embodiment 5, the diameter of the opening 12*a* in the ink supply port 12 is 0.79 mm, an example of the ink holding member 11 is composed of a polyurethane sponge having a specific gravity of 0.052 g/cc and an average hole diameter of 0.30 mm. The volume of the ink holding member 11 has a volume which is 1.37 times the volume which is 1.37 times the volume of the containing section on the side of the lower part in the ink cartridge 10; therefore, the ink holding member 11 is compressed in the containing section on the side of the lower part and, the average diameter of the holes in the ink holding member 11 thug contained in the containing section is approximately 0.27 mm. Another embodiment of the recording head 20 has 50 nozzle holes 21, wherein the nozzle diameter of each nozzle hole 21 is 50 $\mu$m.

(Embodiment 6)

The present embodiment is the same as the above-mentioned embodiment 1 except that in the ink cartridge 10 of the embodiment 6, the diameter of the opening 12*a* in the ink supply port 12 is 0.20 mm. The ink holding member 11 is composed of a polyurethane sponge having a specific gravity of 0.040 g/cc and an average hole diameter of 0.55 mm. The volume of the ink holding member 11 has a volume which is 1.3 times the volume of the containing section on the side of the lower part in the ink cartridge 10; therefore, the ink holding member 11 being compressed in the containing section on the side of the lower part, and the average diameter of the holes in the ink holding member 11 thus contained in containing section is approximately 0.50 mm. Another example of a recording head 20 has 20 nozzle holes 21, where the nozzle diameter of each nozzle hole 21 is 20 $\mu$m.

(Comparative Example 1)

The comparative example is the same as the above-mentioned embodiment 1 except that in the ink cartridge 10 of comparative example 1. The ink holding member 11 is composed of a polyurethane sponge having a specific gravity of 0.052 g/cc and an average hole diameter of 0.30 mm. The volume of the ink holding member 11 has a volume which is 1.5 times the volume of the containing section on the side of the lower part in the ink cartridge 10; therefore, the ink holding member 11 is compressed of containing section on the side of the lower part, and the average diameter of the holes in the ink holding member 11 thus contained in the containing section is approximately 0.25 mm. The same recording head as the recording head 20 in the embodiment 1 is used.

(Comparative Example 2)

The comparative example is the same as the above-mentioned embodiment 1 except that in the ink cartridge 10 of the comparative example 2, the diameter of the opening 12*a* in the ink supply port 12 is 0.20 mm. The ink holding member 11 is composed of a polyurethane sponge having a specific gravity of 0.052 g/cc and an average hole diameter of 0.30 mm. The volume of the ink holding member 11 is the same volume as the volume of the containing section on the side of the lower part in the ink cartridge 10; therefore, the ink holding member 11 is contained in the containing section on the side of the lower side, and the average diameter of the holes in the ink holding member 11 thus contained in the containing section is approximately 0.30 mm. Another example of a recording head 20 has 30 nozzle holes 21, where the nozzle diameter of each nozzle hole 21 is 30 $\mu$m.

(Comparative Example 3)

This comparative example is the same as the above mentioned embodiment 1 except that the ink cartridge 10 of the comparative example 3, the diameter of the opening 12*a* in the ink supply port 12 is 0.06 mm. The ink holding member 11 is composed of a polyurethane sponge having a specific gravity of 0.052 g/cc and an average hole diameter of 0.25 mm. The volume of the ink holding member 11 has a volume which is 1.95 times the volume of the containing section on the side of the lower part in the ink cartridge 10; therefore, the ink holding member 11 is contained upon being compressed in the containing section on the side of the lower part, and the average diameter of the holes in the ink holding member 11 thus contained in the containing section is approximately 0.20 mm. The same recording head as the recording head 20 of embodiment 1 is used.

(Comparative Example 4)

The comparative example is the same as the above-mentioned embodiment 1 except that in the ink cartridge 10 of comparative example 4, the diameter of the opening 12*a* is the ink supply port 12 is 0.19 mm. The ink holding member 11 is composed of a polyurethane sponge having a specific gravity of 0.052 g/cc and an average hole diameter of 0.30 mm. The volume of the ink holding member 11 is the same volume as the volume of the containing section on the side of the lower part in the ink cartridge 10; therefore, the ink holding member 11 is contained in the containing section on the side of the lower part, and the average diameter of the holes in the ink holding member 11 thus contained in the containing section is approximately 0.30 mm. Another example of a recording head 20 has 20 nozzle holes 21, where the nozzle diameter of each nozzle hole 21 is 20 $\mu$m.

(Comparative Example 5)

The comparative example is the same as the above-mentioned comparative example 5 except that in the ink cartridge 10 in the embodiment 1, the diameter of the opening 12*a* in the ink supply port 12 is 0.78 mm. The ink holding member 11 is one composed of a polyurethane sponge having a specific gravity of 0.052 g/cc and an average hole diameter of 0.30 mm. The volume of the ink holding member 11 has a volume which is 1.37 times the volume of the containing section on the side of the lower part in the ink cartridge 10; therefore, the ink holding member 11 is compressed in the containing section on the side of the lower part, and the average diameter of the holes in the ink holding member 11 thus contained in the containing section is approximately 0.27 mm. Another example of a recording head 20 has 50 nozzle holes 21, where the nozzle diameter of each nozzle hole 21 is 50 $\mu$m.

(Comparative example 6)

The comparative example is the same as the above-mentioned comparative example 6 except that in the ink cartridge 10 in the embodiment 1, the diameter of the opening 12*a* in the ink supply port 12 is 0.35 mm. The ink holding member 11 is composed of a polyurethane sponge having a specific gravity of 0.040 g/cc and an average hole diameter of 0.60 mm. The volume of the ink holding member 11 has a volume which is 1.37 times the volume of the containing section on the side of the lower part in the ink cartridge 10; therefore, the ink holding member 11 is compressed in the containing section on the side of the lower part, and the average diameter of the holes in the ink holding member 11 thus contained in the containing section is approximately 0.55 mm. Another example of a recording head 20 has 50 nozzles holes 21, where the nozzle diameter of each nozzle hole 21 is 50 $\mu$m.

(Embodiment 7)

Figure 4:
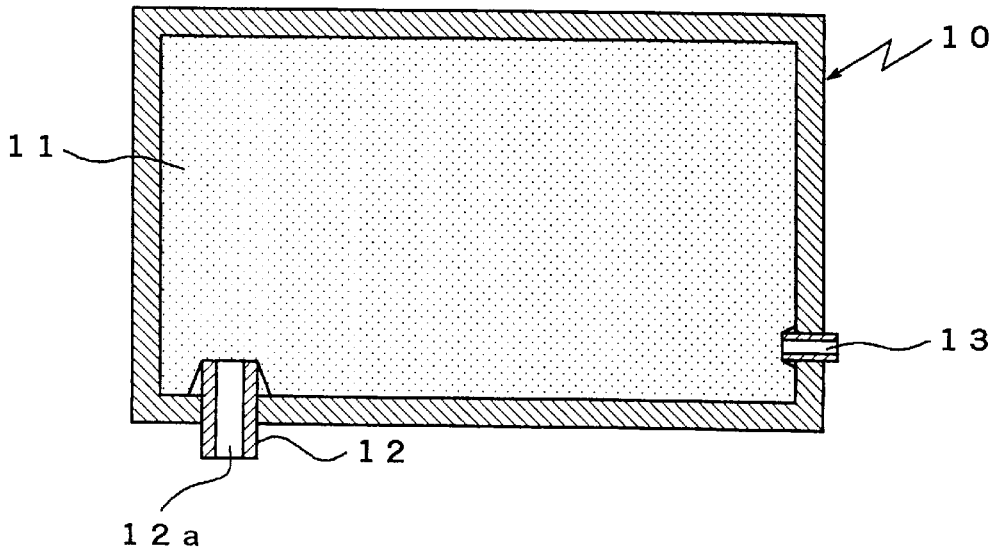
FIG. 4 is a cross-sectional view of an ink cartridge in accordance with embodiment 7 of the present invention and also comparative examples 7 and 8.

In the present embodiment, the above-mentioned partition plate in the ink cartridge 10 in the embodiment 1 is eliminated, as shown in FIG. 4. The diameter of the opening 12*a* in the ink supply port 12 is 0.9 mm. The ink holding member 11 is composed of a polyurethane sponge having a specific gravity of 0.052 g/cc and an average hole diameter of 0.25 mm. The volume of the ink volume holding member 11 is 1.95 times the volume of the ink cartridge 10; therefore, the ink holding member 11 being contained in a compressed state in the ink cartridge 10. When the ink holding member 11 is thus contained, the average diameter of the holes in the ink holding member 11 is approximately 0.20 mm.

The ink 1 is a water-based ink having a viscosity of 2 cP and having surface tension of 30 dyn/cm. The above-mentioned ink holding member 11 contained in the ink cartridge 10 is impregnated with the ink 1.

Another example of a recording head 20 has 50 nozzles holes 21, where the nozzle diameter of each nozzle hole 21 is 50 $\mu$m.

(Comparative Example 7)

The comparative example is the same as the above-mentioned embodiment 7 except that in the ink cartridge 10 in the comparative example 7, an example of the ink holding member 11 is composed of a polyurethane sponge having a specific gravity of 0.040 g/cc and an average hole diameter of 0.25 mm. The volume of the ink holding number 11 is 1.95 times the volume of the ink cartridge 10, thus the ink holding member 11 is contained in a compressed state in the ink cartridge 10. The same recording head as the recording head 20 in the embodiment 7 is used. When the ink holding member 11 is thus contained in the ink cartridge 10, cartridge 10, the average diameter of the holes in the ink holding member 11 is approximately 0.20 mm.

(Comparative Example 8)

The comparative exammple is the same as the above-mentioned embodiment 7 except that in the ink cartridge 10 in the comparative example 8, the diameter of the opening 12*a* in the ink supply port 12 is 0.7 mm. The ink holding member 11 is one composed of a polyurethane sponge having a specific gravity of 0.040 g/cc and an average hole diameter of 0.50 mm. The volume of the ink holding member 11 has a volume which is 1.95 times the volume of the ink cartridge 10, thus the ink holding member 11 is contained in a compressed state in the ink cartridge 10. The same recording head as the recording head 20 in the embodiment 7 is used. When the ink holding member 11 is thus contained, the average diameter of the holes in the ink holding member 11 is approximately 0.40 mm.

(Embodiment 8)

Figure 5:
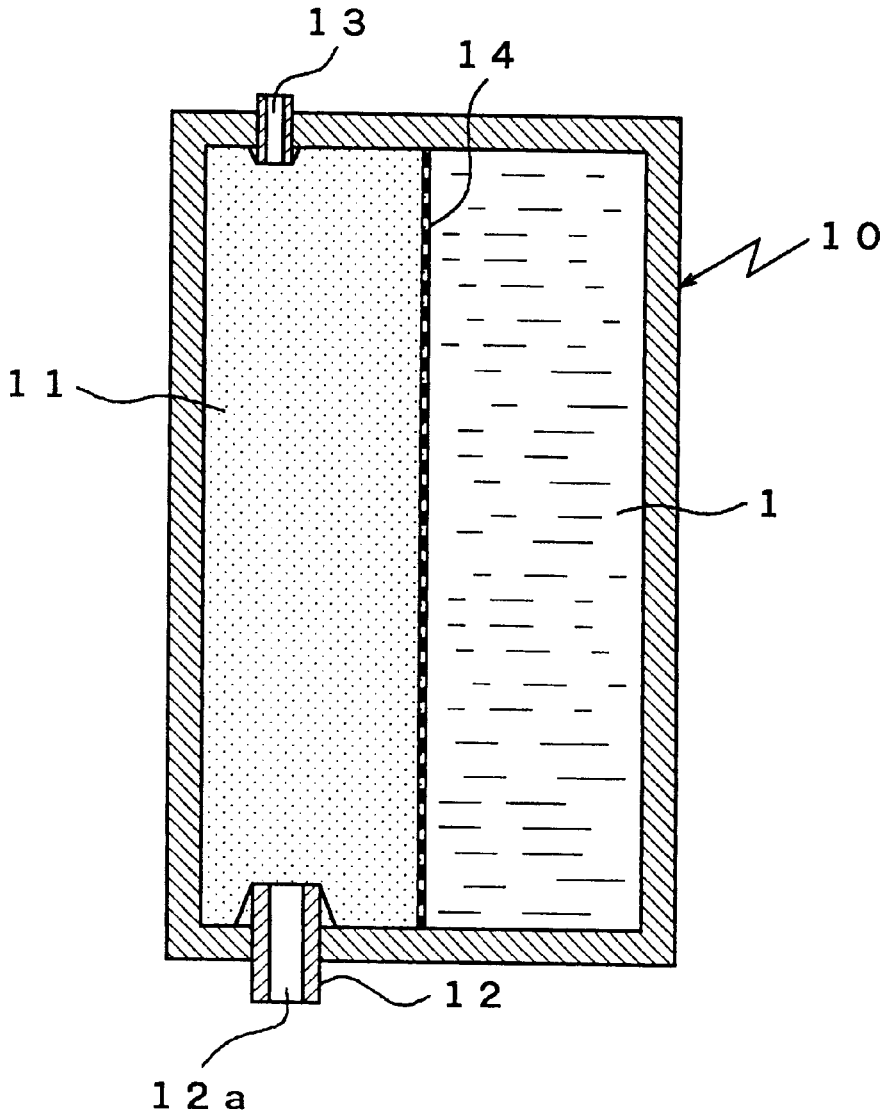
FIG. 5 is a cross-sectional view of an ink cartridges in accordance with embodiment 8 of the present invention and also comparative example 7 and 8.

In the present embodiment, the direction of the ink cartridge 10 of embodiment 1 is changed. The partition plate 14 having a plurality of holes is provided in a vertical direction relative to the ink cartridge 10 to separate the ink cartridge 10 into right and left parts. The ink cartridge 10 has a height of 35 mm, a depth of 20 mm and a width of 20 mm, and the volume of a containing section containing an ink holding member 11 is 30% of the internal volume of the ink cartridge 10, as shown in FIG. 5. In the containing section, a vent hole 13 is provided in an upper surface of the ink cartridge 10, and an ink supply port 12 having an opening 12*a* the diameter of which is 0.6 mm is provided in a bottom surface thereof.

An example of the ink holding member 11 is composed of a polyurethane sponge having a specific gravity of 0.052 g/cc and an average hole diameter of 0.3 mm. The volume of the ink holding member 11 has the same volume as the volume of the above-mentioned containing section, thus the ink holding member 11 is contained in the containing section. When the ink holding member 11 is thus contained, the average diameter of the holes in the ink holding member 11 is approximately 0.30 mm.

An example of the ink 1 is a water-based ink having a viscosity of 2 cP and having surface tension of 30 dyn/cm. The ink 1 is contained in an ink containing section separated from the above-mentioned containing section by the partition plate 14, and the ink holding member 11 is impregnated with the ink 1.

An example of the recording head 20 has 30 nozzle holes 21, where the nozzle diameter of each nozzle hole 21 is 30 $\mu$m.

(Comparative Example 9)

This comparative example is the same as the above-mentioned embodiment 8 except that in the ink cartridge 10 in the comparative example 9, the diameter of the opening 12*a* in the ink supply port 12 is 0.8 mm. The ink holding member 11 is composed of a polyurethane sponge having a specific gravity of 0.047 g/cc and an average hole diameter of 0.50 mm. The volume of the ink holding member 11 has a volume which is 1.40 times the volume of the containing section in the ink cartridge 10; therefore, the ink holding member 11 is compressed in the ink cartridge 10, the average diameter of the holes in the ink holding member 11 is approximately 0.45 mm when the ink holding member 11 is thus contained. Another example of the recording head 20 includes 50 nozzle holes 21, where the nozzle diameter of each nozzle hole is 50 $\mu$m.

For each of the ink jet recorders of the embodiments 1 to 8 and the comparative examples 1 to 9, the cross-sectional area S0 ($mm^2$) of the opening 12*a* in the ink supply port 12, the sum S1 ($mm^2$) of the cross-sectional areas of the openings in all the nozzle holes 21 in the recording head 20, and the average cross-sectional area S2 ($mm^2$) of the holes in the ink holding member 11 with which the ink cartridge 10 is filled are shown in the following Table 1. Table 1 further reflects whether or not the relationship among S0, S1 and S2 for each of the ink jet recorders satisfies a first condition indicated by the following expression (1), and a second condition indicated by the following expression (2). Of note, a case where a condition is satisfied is indicated by ○, and a case where a condition is not satisfied is indicated by X:

$$(1/S2)\times(1/35)>S0 \quad (1)$$

$$S0\geqq S1\times 5 \quad (2)$$

TABLE 1

| | S0 ($mm^2$) | S1 ($mm^2$) | S2 ($mm^2$) | CONDITIONS 1 | CONDITIONS 2 |
|---|---|---|---|---|---|
| EMBODIMENT 1 | 0.785 | 0.031 | 0.147 | ○ | ○ |
| EMBODIMENT 2 | 0.636 | 0.098 | 0.031 | ○ | ○ |
| EMBODIMENT 3 | 0.283 | 0.014 | 0.071 | ○ | ○ |
| EMBODIMENT 4 | 0.071 | 0.006 | 0.159 | ○ | ○ |
| EMBODIMENT 5 | 0.490 | 0.098 | 0.057 | ○ | ○ |
| EMBODIMENT 6 | 0.031 | 0.006 | 0.196 | ○ | ○ |
| EMBODIMENT 7 | 0.636 | 0.098 | 0.031 | ○ | ○ |
| EMBODIMENT 8 | 0.283 | 0.014 | 0.071 | ○ | ○ |
| COMPARATIVE EXAMPLE 1 | 0.785 | 0.147 | 0.049 | × | ○ |
| COMPARATIVE EXAMPLE 2 | 0.031 | 0.014 | 0.071 | ○ | × |
| COMPARATIVE EXAMPLE 3 | 0.283 | 0.147 | 0.031 | ○ | × |
| COMPARATIVE EXAMPLE 4 | 0.028 | 0.006 | 0.071 | ○ | × |

TABLE 1-continued

| | S0 ($mm^2$) | S1 ($mm^2$) | S2 ($mm^2$) | CONDITIONS 1 | CONDITIONS 2 |
|---|---|---|---|---|---|
| COMPARATIVE EXAMPLE 5 | 0.478 | 0.098 | 0.057 | × | × |
| COMPARATIVE EXAMPLE 6 | 0.096 | 0.006 | 0.237 | × | × |
| COMPARATIVE EXAMPLE 7 | 0.636 | 0.098 | 0.126 | × | ○ |
| COMPARATIVE EXAMPLE 8 | 0.385 | 0.098 | 0.126 | × | × |
| COMPARATIVE EXAMPLE 9 | 0.502 | 0.098 | 0.159 | × | ○ |

For each of the ink jet recorders of the embodiments 1 to 8 and the comparative examples 1 to 9, the discharge performance of the ink from the recording head 20 was evaluated, and a leak test for the ink cartridge 10 was carried out. The results thereof were shown in the following Table 2.

With respect to the discharge performance from the recording head 20, the ink supply port 12 in each of the ink cartridges 10 was connected to a tube pump and the ink was sucked at set flow rates of 5 ml/min and 10 ml/min by the tube pump, to evaluate the discharged state. A case where the amount of discharge was not decreased so that the ink was stably supplied is indicated by ○, a case where the amount of discharge was slightly decreased was indicated by A, and a case where the amount of discharge is significantly decreased is indicated by X.

With respect to the leak test for each of the ink cartridges 10, the amounts of leakage of the ink 1 under the three conditions A, B and C were measured. Under condition A, the amount of ink leakage was measured in a case where the ink I was left for one hour at an ambient temperature of 0° C. and was then left for five hours after the ambient temperature was raised to 30° C. in twenty minutes. The ink supply port 12 in the ink cartridge 10 was closed, while the vent hole 13 was opened. Under condition B, the amount of ink leakage was measured in a case where the ink 1 was left for 24 hours at an ambient temperature of 20° C. The ink supply port 12 was directed sideward, and the ink supply port 12 and the vent hole 13 in the ink cartridge 10 were opened. Further, under the condition C, the amount of leakage of the ink 1 was measured in a case where the ink 1 was left for 24 hours at an ambient temperature of 20° C. The ink supply port 12 was directed downward, and the ink supply port 12 and the vent hole 13 in the ink cartridge 10 were opened. The results thereof were shown in Table 2.

TABLE 2

| | DISCHARGE PERFORMANCE (ml/min) | | LEAK TEST (ml) | | |
|---|---|---|---|---|---|
| | 5 | 10 | A | B | C |
| EMBODIMENT 1 | ○ | ○ | 0 | 0 | 0.10 |
| EMBODIMENT 2 | ○ | ○ | 0 | 0 | 0.12 |
| EMBODIMENT 3 | ○ | ○ | 0 | 0 | 0.15 |
| EMBODIMENT 4 | ○ | ○ | 0 | 0 | 0.11 |
| EMBODIMENT 5 | ○ | ○ | 0 | 0 | 0.10 |
| EMBODIMENT 6 | ○ | ○ | 0 | 0 | 0.21 |
| EMBODIMENT 7 | ○ | ○ | 0 | 0 | 0.15 |
| EMBODIMENT 8 | ○ | ○ | 0 | 0 | 0.13 |
| COMPARATIVE EXAMPLE 1 | ○ | ○ | 0 | 0.15 | 0.50 |

TABLE 2-continued

| | DISCHARGE PERFORMANCE (ml/min) | | LEAK TEST (ml) | | |
|---|---|---|---|---|---|
| | 5 | 10 | A | B | C |
| COMPARATIVE EXAMPLE 2 | ○ | Δ | 0 | 0 | 0.12 |
| COMPARATIVE EXAMPLE 3 | Δ | × | 0 | 0 | 0.05 |
| COMPARATIVE EXAMPLE 4 | ○ | × | 0 | 0 | 0.21 |
| COMPARATIVE EXAMPLE 5 | Δ | × | 0 | 0.30 | 0.80 |
| COMPARATIVE EXAMPLE 6 | ○ | ○ | 0 | 0.30 | 0.80 |
| COMPARATIVE EXAMPLE 7 | ○ | ○ | 0 | 0.20 | 0.80 |
| COMPARATIVE EXAMPLE 8 | Δ | × | 0 | 0.15 | 0.50 |
| COMPARATIVE EXAMPLE 9 | ○ | ○ | 0.10 | 0.25 | 1.50 |

For each of the ink jet recorders of the embodiments 1 to 8 in which the cross-sectional area SO of the opening 12*a* in the ink supply port 12 provided in the ink cartridge 10, the average cross-sectional area S2 of the holes in the ink holding member 11 with which the ink cartridge 10 is filled, and the sum S1 of the cross-sectional areas of the openings in all the nozzle holes 21 in the recording head 20 satisfy the conditions indicated by the foregoing expressions (1) and (2), even when the ink 1 is discharged at high speed via the tube pump, the ink 1 was stably supplied to the recording head 20. Further, the leakage of the ink 1 in the ink cartridge 10 was significantly reduced.

On the other hand, for each of the ink jet recorders of the comparative examples in which the cross-sectional area S0 of the opening 12*a* in the ink supply port 12 and the average cross-sectional area S2 of the holes in the ink holding member 11 with which the ink cartridge 10 is filled do not satisfy the conditions indicated by the foregoing expression (1), the ink badly leaked. Further, for each of the ink jet recorders in the comparative examples in which the cross-sectional area SO of the opening 12*a* in the ink supply port 12 and the sum of the cross-sectional areas of the openings in all the nozzle holes 21 in the recording head 20 do not satisfy the conditions indicated by the foregoing expression (2), the ink was not stably discharged when drawn at high speed.

A case where the ink supply port 12 in the ink cartridge 10 is provided with a plurality of openings 12*a* will be specifically described on the basis of the accompanying drawings.

In a case where the ink supply port 12 is provided with the plurality of openings 12*a*, when the sum of the cross-sectional areas of the openings 12*a* is set to not less than 0.25 $mm^2$ as described above, the ink is stably supplied to the recording head through each of the openings 12*a* in the ink supply port 12 even in consuming the ink in large amounts as in a case where printing is continuously done, so that stable recording can be made. On the other hand, if the sum of the cross-sectional areas of the openings 12*a* is too large, the ink easily leaks through the openings 12*a*. Therefore, it is preferable that the sum of the cross-sectional areas of the openings 12a is not more than 1.0 $mm^2$.

Furthermore, the shape of each of the openings 12*a* provided in the ink supply port 12 is not particularly limited. For example, slit-shaped or circular openings can be provided.

When a plurality of slit-shaped openings 12*a* are provided, it is preferable that the slit width of each of the openings 12*a* is not more than 0.2 mm in order to prevent the ink from leaking through the openings 12*a*. On the other hand, when a plurality of circular openings are provided, it is preferable that the diameter of each of the openings 12*a* is not more than 0.4 mm in order to prevent the ink from leaking through the openings 12*a*.

Description is now made of experimental examples in which the number, the shape, the size and the like of the openings 12*a* provided in the ink supply port 12 are changed.

(Embodiment 9)

Figure 6:
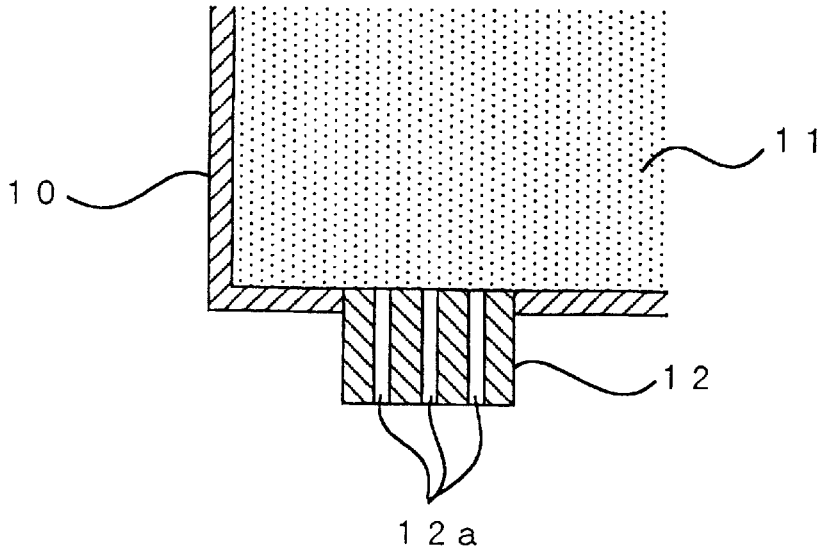
FIG. 6 is a partial sectional view of an ink cartridge in accordance with embodiment 9 of the present invention.

In this Embodiment 9, in a cartridge 10 formed of ABS resin, an ink holding member 11 composed of a polyurethane sponge having a specific gravity of 0.05 g/cc, an average hole diameter of 0.2 mm, and a volume which is approximately 1.5 times the volume of the inside of the cartridge 10 is contained upon being compressed, as shown in FIG. 6. Further, a water-based ink, having a viscosity of 2 cP and a surface tension of 30 dyn/cm, is supplied to the ink holding member 11 and is held in the ink holding member 11.

Figure 7:
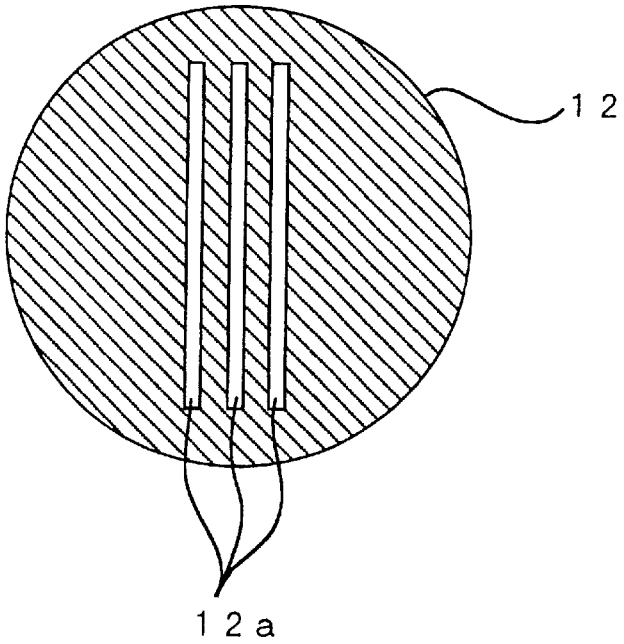
FIG. 7 is a plan view illustrating the orientation and the shape of the openings of the ink supply port of the ink cartridge of FIG. 7.

An ink supply port 12 for supplying the ink to a recording head or the like is provided in the bottom of the ink cartridge 10, and an opening 12*a* for guiding the ink is provided in such a manner that the ink passes through the ink supply port 12. In the embodiment, three slit-shaped openings 12*a* having a slit width of 0.2 mm and a length of 4.5 mm are provided with required spacing, as shown in FIG. 7 and the following Table 3.

(Embodiment 10)

Figure 8:
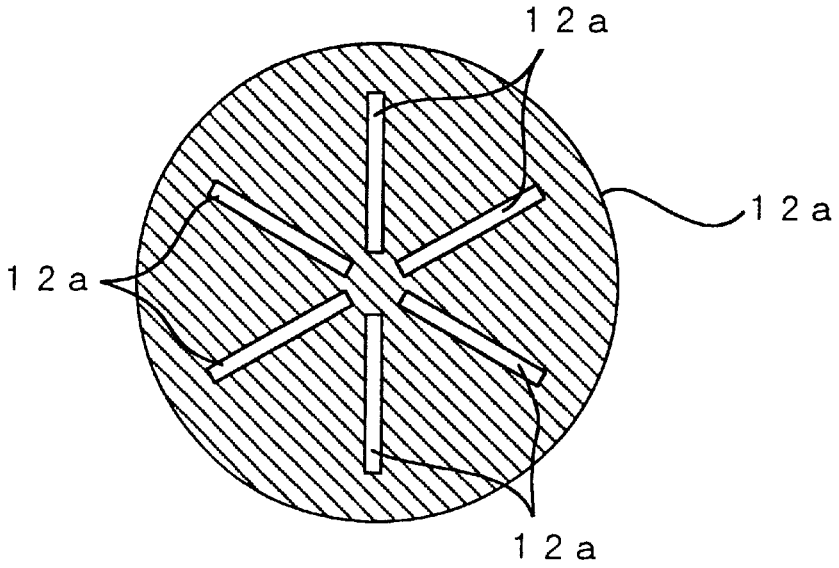
FIG. 8 is a plan view illustrating an alternative orientation and shape of the openings of an ink supply port of embodiment 10 of the ink cartridge of the present invention.

An ink cartridge in this embodiment 10 is the same as the ink cartridge in the above-mentioned embodiment 9 except that only the openings 12*a* provided in the ink supply port 12 are changed. In this embodiment, six slit-shaped openings 12*a* having a slit width of 0.2 mm and a length of 2.0 mm are radially provided, as shown in FIG. 8 and the following Table 3.

(Embodiment 11)

Figure 9:
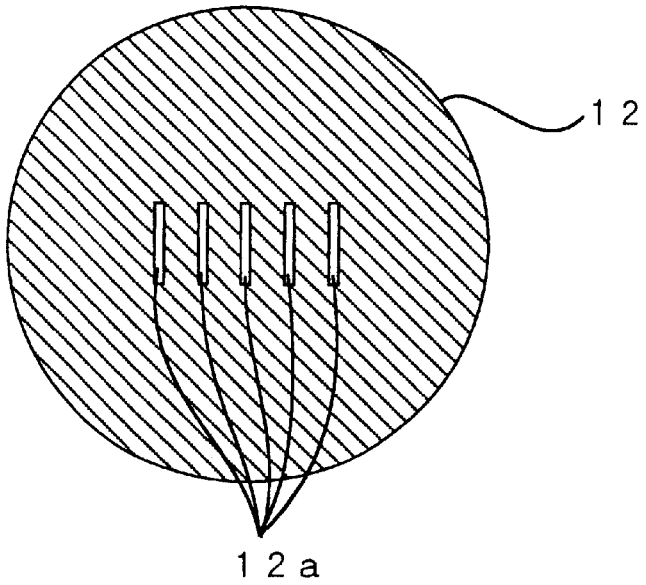
FIG. 9 is a plan view illustrating an alternative orientation and shape of the openings of an ink supply port of embodiment 11 of the ink cartridge of the present invention.

An ink-cartridge in this embodiment 11 is also the same as the ink cartridge in the above-mentioned embodiment 9 except that only the openings 12*a* provided in the ink supply port 12 are changed. In this embodiment, five slit-shaped openings 12*a* having a slit width of 0.2 mm and a length of 1.0 mm are provided with required spacing, as shown in FIG. 9 and the following Table 3.

(Embodiment 12)

Figure 10:
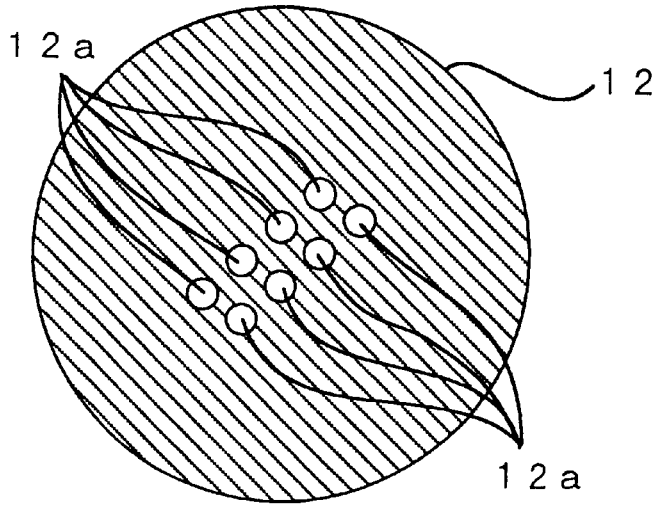
FIG. 10 is a plan view illustrating an alternative orientation and shape of the openings of an ink supply port of embodiment 12 of the ink cartridge of the present invention.

An ink cartridge in this embodiment 12 is also the same as the ink cartridge in the above-mentioned embodiment 9 except that only the openings 12*a* provided in the ink supply port 12 are changed. In the embodiment, eight circular openings 12*a* having a diameter of 0.38 mm are provided, as shown in FIG. 10 and the following Table 3.

(Comparative Example 10)

Figure 11:
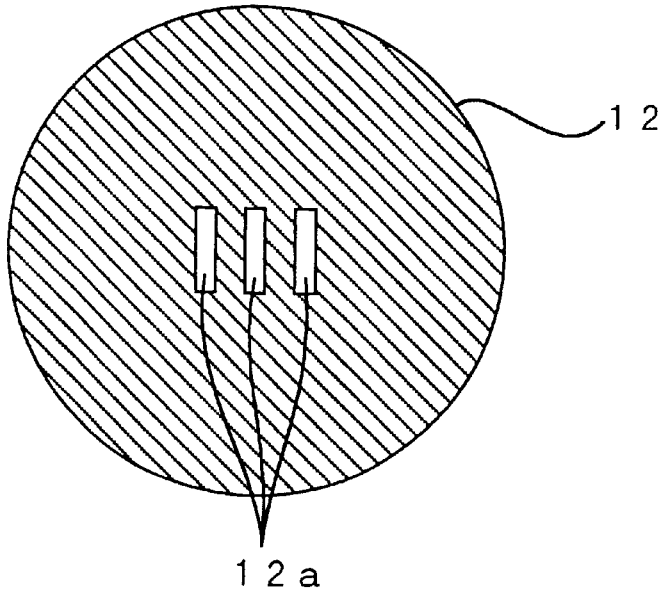
FIG. 11 is a plan view illustrating the orientation and the shape of the openings of an ink supply port for comparative example 10.

An ink cartridge in this comparative example 10 is also the same as the ink cartridge in the above-mentioned embodiment 9 except that only the openings 12*a* provided in the ink supply port 12 are changed. In this comparative example, three slit-shaped openings 12*a* having a slit width of 0.25 mm and a length of 1.0 mm are provided, as shown in FIG. 11 and the following Table 3.

(Comparative Example 11)

Figure 12:
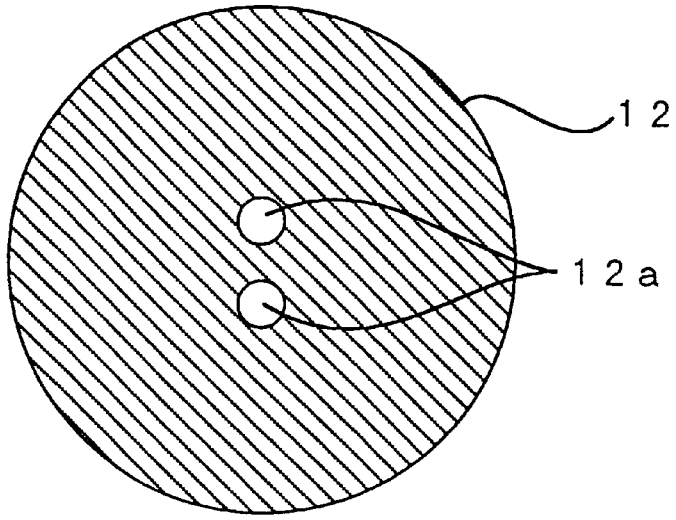
FIG. 12 is a plan view illustrating the orientation and the shape of the openings of an ink supply port for comparative example 11.

An ink cartridge in the comparative example 11 is also the same as the ink cartridge in the above-mentioned embodiment 9 except that only the openings 12*a* provided in the ink supply port 12 are changed. In this comparative example, two circular openings 12*a* having a diameter of 0.55 mm are provided, as shown in FIG. 12 and the following Table 3.

(Comparative Example 12)

Figure 13:
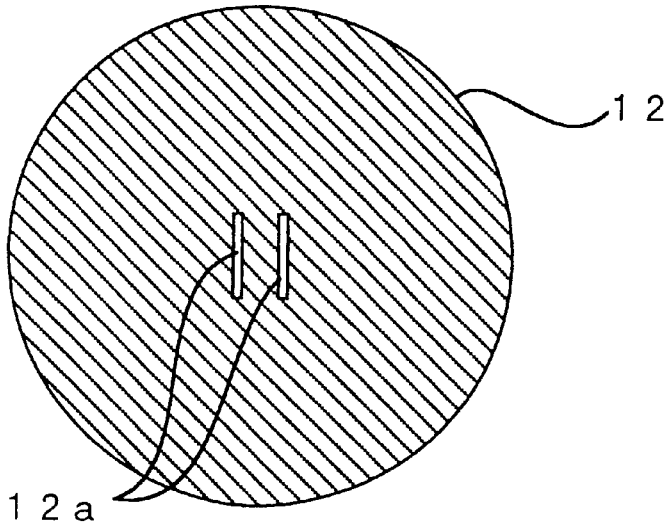
FIG. 13 is a plan view illustrating the orientation and the shape of the openings of an ink supply port for comparative example 12.

An ink cartridge in this comparative example 12 is also the same as the ink cartridge in the above-mentioned embodiment 9 except that only the openings 12*a* provided in the ink supply port 12 are changed. In this comparative example, two slit-shaped openings 12*a* having a slit width of 0.1 mm and a length of 1.0 mm are provided with required spacing, as shown in FIG. 13 and the following Table 3.

For each of the ink cartridges of the embodiments 9 to 12 and comparative examples 10 to 12, the sum of the cross-sectional areas of all the openings 12*a* provided in the ink supply port 12 was found. The results thereof were shown in the following Table 3.

A tube pump (not shown) was connected to the ink supply port 12 for each of the ink cartridges of the embodiments 9 to 12 and comparative examples 10 to 12, and the ink was drawn by the tube pump to examine the discharge performance of the ink cartridges. The results thereof were shown in the following Table 3. With respect to the discharge performance, a case where the amount of discharge of the ink discharged through the openings 12*a* by the suction using the tube pump was a set value was indicated by ○, and a case where it was not more than 90% of the set value was indicated by X.

With respect to each of the ink cartridges in the embodiments 9 to 12 and comparative examples 10 to 12, the leak performance in the ink cartridge was examined at the time point where the amount of ink held in the ink holding member 11 was reduced to approximately one-half. The results thereof were also shown in the following Table 3. With respect to the leak performance, a case where the ink did not leak even when the ink cartridge was dropped from a height of 70 cm is indicated by ◎, a case where the ink leaked when it was dropped from a height of 70 cm, while the ink did not leak when the ink was left for one day with the ink supply port 12 directed downward is indicated by ○, and a case where the ink leaked when the ink was left for one day with the ink supply port directed downward is indicated by X.

TABLE 3

| | OPENING | | | | | |
|---|---|---|---|---|---|---|
| | SHAPE | DIMENSIONS (mm) WIDTH X LENGTH, DIAMETER | NUMBER | TOTAL CROSS-SECTIONAL AREA ($mm^2$) | DISCHARGE PERFORMANCE | LEAK PERFORMANCE |
| EMBODIMENT 9 | slit | 0.2 × 4.5 | 3 | 2.70 | ○ | ○ |
| EMBODIMENT 10 | slit | 0.2 × 2.0 | 6 | 2.40 | ○ | ○ |
| EMBODIMENT 11 | slit | 0.1 × 1.0 | 5 | 0.50 | ○ | ◎ |
| EMBODIMENT 12 | circle | 0.38 | 8 | 0.91 | ○ | ◎ |
| COMPARATIVE EXAMPLE 10 | slit | 0.25 × 1.0 | 3 | 0.75 | ○ | × |
| COMPARATIVE EXAMPLE 11 | circle | 0.55 | 2 | 0.47 | ○ | × |
| COMPARATIVE EXAMPLE 12 | slit | 0.1 × 1.0 | 2 | 0.20 | × | ◎ |

As a result, for the ink cartridge of the comparative example 10 provided with the openings 12 having a large slit width, and the ink cartridge in the comparative example 11 provided with the openings 12*a* having a large diameter, the discharge performance of the ink was sufficient; however, these ink cartridges exhibited ink leakage. On the other hand, in the ink cartridge of the comparative example 12 in which the cross-sectional area of the whole of the openings 12*a* is small, the ink was inhibited from leaking, but the ink was not sufficiently discharged.

On the other hand, for each of the ink cartridges of the embodiments 9 to 12 in which the sum of the cross-sectional areas of the openings 12*a* is set to not less than 0.25 $mm^2$, the slit width of each of the openings 12*a* is set to not more than 0.2 mm when the openings are in a slit shape, while the diameter of each of the openings 12*a* is set to not more than 0.4 mm when the openings are circular, the discharge performance of the ink was sufficient, and the ink was prevented from leaking. Particularly, for the ink cartridges in the embodiments 11 and 12 in which the sum of the cross-sectional areas of the openings 12*a* is not more than 1.0 $mm^2$, the ink was further prevented from leaking.

Figure 14:
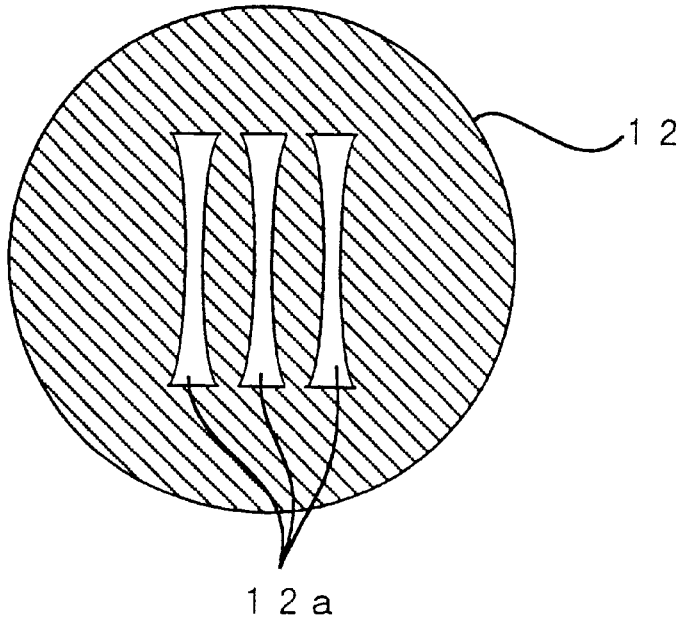
FIG. 14 is a plan view illustrating an alternative orientation and shape of the openings of an ink supply port of embodiment 9 of the ink cartridge of the present invention.
Figure 14:
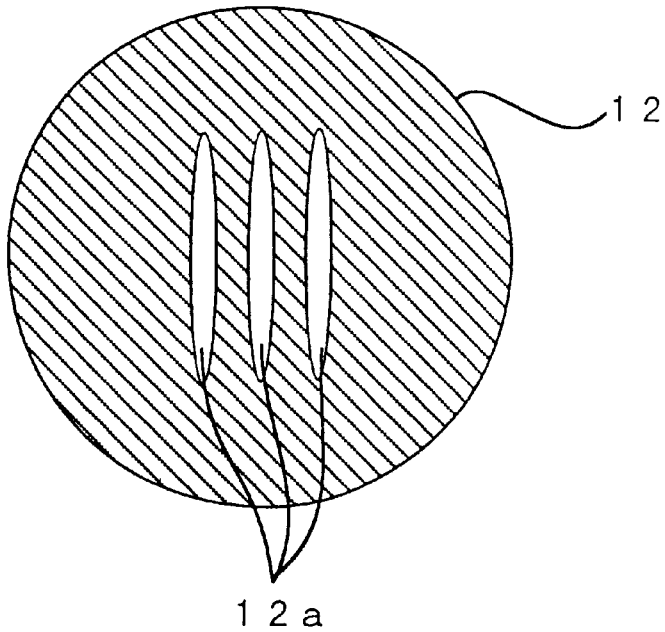

Although for the ink cartridge of the embodiment 9, each of the slit-shaped openings 12*a* is formed in a rectangular shape, the openings can be formed in shapes obtained by slightly curving the slit-shaped opening 12*a*, as shown in FIGS. 14(A) and 14(B).

Although the present invention has been fully described by way of example, it is to be noted that various changes and modification will be apparent to those skilled in the art.

Therefore, unless such changes and modifications depart from the scope of the present invention, they should be construed as being included herein.

What is claimed is:

1. An ink jet recorder, comprising:

an ink cartridge having an ink supply port for supplying ink to a recording head and an ink holding member composed of a porous member for holding the ink, the ink holding member being so arranged inside the ink cartridge as to cover the ink supply port, and the recording head, having a plurality of nozzle openings, communicates with the ink supply port of the ink cartridge wherein the ink jet recorder satisfies the following condition:

$$(1/S2)\times(1/35)>S0\geqq S1\times 5$$

where

S0: a cross-sectional area of an ink supply port opening,

S1: a total sum of cross-sectional areas of the plurality of nozzle openings, and S2: an average cross-sectional area of holes in the ink holding member.

2. The ink jet recorder according to claim 1, wherein the ink holding member is composed of a polyurethane sponge.

3. The ink jet recorder according to claim 1, wherein the ink cartridge includes an ink containing section containing the ink and a holding member containing section containing the ink holding member.

4. The ink jet recorder according to claim 1, wherein the ink cartridge has a vent hole for introducing air into the cartridge.

5. The ink jet recorder according to claim 4, wherein the vent hole is provided in a side surface of the ink cartridge, and the ink supply port is provided in a lower surface thereof.

6. The ink jet recorder according to claim 5, wherein the ink cartridge is shaped so that a first length of the ink cartridge, which is parallel to a direction of ink discharge through the ink supply port, is less than a second length of the ink cartridge, which is perpendicular to the direction of ink discharge through the ink supply port.

7. The ink jet recorder according to claim 4, wherein the vent hole is provided in an upper surface of the ink cartridge, and the ink supply port is provided in a lower surface thereof.

8. The ink jet recorder according to claim 7, wherein the ink cartridge is shaped so that a first length of the ink cartridge, which is parallel to a direction of ink discharge through the ink supply port, is greater than a second length of the ink cartridge, which is perpendicular to the direction of ink discharge through the ink supply port.

9. An ink cartridge to supply ink to a recording head of an ink jet printing device, the ink cartridge comprising:

an ink holding member, positioned within the ink cartridge, to hold ink; and an ink supply port for supplying ink held in the ink holding member to the recording head, wherein an end portion of the ink supply port protrudes from the ink cartridge and another end portion of the ink supply port contacts the ink holding member, wherein the ink supply port includes a plurality of openings to operatively supply ink to the recording head but inhibit an otherwise natural flow of the ink through the ink supply port, and wherein each of the openings is in a slit shape in cross section, a width of each slit is not more than 0.2 mm, and a total sum of cross-sectional areas of the plurality of openings is not less than 0.25 $mm^2$.

10. The ink cartridge according to claim 9, wherein the total sum of the cross-sectional areas of the plurality of openings is not less than 0.25 $mm^2$ nor more than 1.0 $mm^2$.

11. An ink cartridge to supply ink to a recording head of an ink jet printing device, the ink cartridge comprising:

an ink holding member, positioned within the ink cartridge, to hold ink; and an ink supply port for supplying ink to the recording head, wherein an end portion of the ink supply port protrudes from the ink cartridge and another end portion of the ink supply port contacts the ink holding member, wherein the ink supply port includes a plurality of openings to operatively supply ink to the recording head but inhibit an otherwise natural flow of the ink through the ink supply port, and wherein each of the openings is circular in cross section, a diameter of each opening is not more than 0.4 mm, and a total sum of cross-sectional areas of the plurality of openings is not less than 0.25 $mm^2$.

12. The ink cartridge according to claim 11, wherein the total sum of the cross-sectional areas of the plurality of openings is not less than 0.25 $mm^2$ nor more than 1.0 $mm^2$.

13. An ink cartridge to supply ink to a recording head of an ink jet printing device, the ink cartridge comprising:

an ink holding member, positioned within the ink cartridge, for holding ink; and an ink supply member for supplying ink held in the ink holding member to the recording head, wherein a first end portion of the ink supply member protrudes from the ink cartridge and another end portion of the ink supply member contacts the ink holding member, wherein the ink supply member includes a plurality of passages, extending between the first end portion and the end portion contacting the ink holding member, and wherein each passage of the plurality of passages has a slit cross sectional shape, whereas a width of each slit is not more than 0.2 mm, and a total sum of cross sectional areas of the plurality of passages is not less that 0.25 $mm^2$.

14. An ink cartridge to supply ink to a recording head of an ink jet printing device, the ink cartridge comprising:

an ink holding member, positioned within the ink cartridge, for holding ink; and an ink supply member for supplying ink held in the ink holding member to the recording head, wherein a first end portion of the ink supply member protrudes from the ink cartridge and another end portion of the ink supply member contacts the ink holding member, wherein the ink supply member includes a plurality of passages, extending between the first end portion and the end portion contacting the ink holding member, and wherein each passage of the plurality of passages has a circular cross section, whereas a diameter of each passage is not more than 0.4 mm and a total sum of cross-sectional areas of the plurality of passages is not less than 0.25 $mm^2$.

* * * * *